US006301981B1

(12) United States Patent
Oechslin

(10) Patent No.: US 6,301,981 B1
(45) Date of Patent: Oct. 16, 2001

(54) ESCAPEMENT FOR A TIMEKEEPER

(75) Inventor: Ludwig Oechslin, Lucerne (CH)

(73) Assignee: Ulysse Nardin S.A., Le Locle (CH)

( * ) Notice: Subject to any disclaimer, the term of this patent is extended or adjusted under 35 U.S.C. 154(b) by 0 days.

(21) Appl. No.: 09/531,170

(22) Filed: Mar. 21, 2000

(30) Foreign Application Priority Data

Mar. 31, 1999 (EP) ..... 99106602

(51) Int. Cl.[7] ..... G04B 15/00

(52) U.S. Cl. ..... 74/1.5; 74/435; 74/437; 185/38; 368/127; 368/129

(58) Field of Search ..... 74/1.5, 435, 437; 185/5, 38; 368/127, 128, 129, 130, 131

(56) References Cited

U.S. PATENT DOCUMENTS 2,354,020 * 7/1944 Honger ..... 368/124
3,143,848 * 8/1964 Biemiller et al. ..... 368/130

FOREIGN PATENT DOCUMENTS 263 069 11/1949 (CH) .
24 58 503 6/1976 (DE) .

* cited by examiner

*Primary Examiner*—Allan D. Herrmann
(74) *Attorney, Agent, or Firm*—Sughrue, Mion, Zinn, Macpeak & Seas, PLLC

(57) ABSTRACT

The escapement (10) includes first (6) and second (7) wheels meshing with each other. One (6) of these wheels is driven by the gear train. First (9) and second (11) rollers secured to a common arbor (1) support a sprung balance. The wheels (6, 7) and the first roller (9) are provided with means allowing said first roller to receive direct impulses supplied alternately by the first and second wheels for the purpose of maintaining the oscillations of the balance. The second roller (11) is provided with means for driving a locking and rocking member arranged to lock said first and second wheels alternately.

6 Claims, 6 Drawing Sheets

ESCAPEMENT FOR A TIMEKEEPER

BACKGROUND OF THE INVENTION

The present invention relates to an escapement arranged between a gear train and a sprung balance of a timekeeper.

The main escapements known in watchmaking will be recalled hereinafter. The escapement is placed between the gear train, namely the set of wheels and pinions which, from the barrel, transmits the driving force to the escapement wheel, and the regulating organ of most timekeepers. It is known that function of the escapement is to the oscillations of the regulating organ whether a balance or a pendulum. The advantages and drawbacks of known escapements and the consequences resulting from such drawbacks as regards the working of the timepiece will be described hereinafter.

The Swiss lever escapement, used for almost all watches, has an escapement wheel which co-operates with two pallet-stones the movement of whose fork is limited by banking-pins. The fork co-operates with an impulse-pin carried by a roller secured to the balance-staff. The system provides two pulses via the oscillation of the balance and is self-starting. Those skilled in the art know that in order to prevent the phenomenon of overbanking, where the impulse-pin can strike against the back of the horns of the fork, a safety device called a draw, which holds the fork against the banking-pin while the balance is turning through its free oscillation arc, is used. The effect of the draw is transformed into inclination of the locking-face of the pallet-stone, which causes the escapement wheel to recoil at the moment of release. This recoil has the drawback of braking the balance and thus consuming power. It should also be noted that the balance receives its pulses via the pallets and not directly via the escapement wheel.

The detent escapement, which is expensive and delicate, is used mainly in chronometry. It is formed of a wheel with pointed teeth which rest on a jewel called the locking stone. This jewel is carried by a spring called the detent, an extension of which extends within the range of action of the discharging-pallet carried by a safety roller secured to the balance. The pallet unlocks the wheel each time the balance oscillates. The tooth of the wheel leaves the locking-stone and another tooth, acting on the impulse-pallet carried by the impulse-roller, which is coaxial and secured to the small roller, gives an impulse to the balance. This system has the advantage of having a direct impulse and not having any recoil during unlocking. However, this system has the drawback of being prone to overbanking when the balance describes the free arc and if a shock is applied to the timekeeper during such period. The watch can then stop. It will also be mentioned that this escapement provides a single impulse to the balance during an oscillation, which slightly reduces the yield of the system. Finally and by design, this system is not self-starting which also constitutes a drawback.

The cylinder escapement includes an escape-wheel which co-operates with a cylinder on which is mounted the sprung balance. The cylinder is formed by a small polished steel tube with an opening into which the teeth of the wheel can successively penetrate. The two ends of the cylinder are closed by steel plugs carrying the cylinder pivot. This system is advantageous because of the direct impulses which it proposes. Moreover, it is self-starting and, by its very design, is fully secure against overbanking. However, the system has the major drawback that, during the free arc, the tip of the tooth of the wheel constantly rubs against the inner or outer shell of the cylinder, which consumes power.

SUMMARY OF THE INVENTION

In order to avoid the drawbacks of the systems described hereinbefore, while preserving the advantages thereof, the present invention proposes a new escapement, called an impulse wheel escapement. This new escapement is characterized in that it includes first and second impulse wheels meshing with each other, one of these wheels being driven by the gear train, and first and second roller -tables, hereinafter just referred to as rollers, secured to a common arbor to which the sprung balance is fixed, the first and second wheels and the first roller being provided with means allowing said first roller to receive direct impulses supplied alternately by the first and second wheels for the purpose of maintaining the oscillations of the balance, said second roller being provided with means for driving a locking and rocking member arranged to lock said first and second wheels alternately.

The invention will be explained in detail hereinafter by an embodiment given by way of example, this embodiment being illustrated by the annexed drawings, in which:

DETAILED DESCRIPTION OF THE PREFERRED EMBODIMENTS

Figure 1:
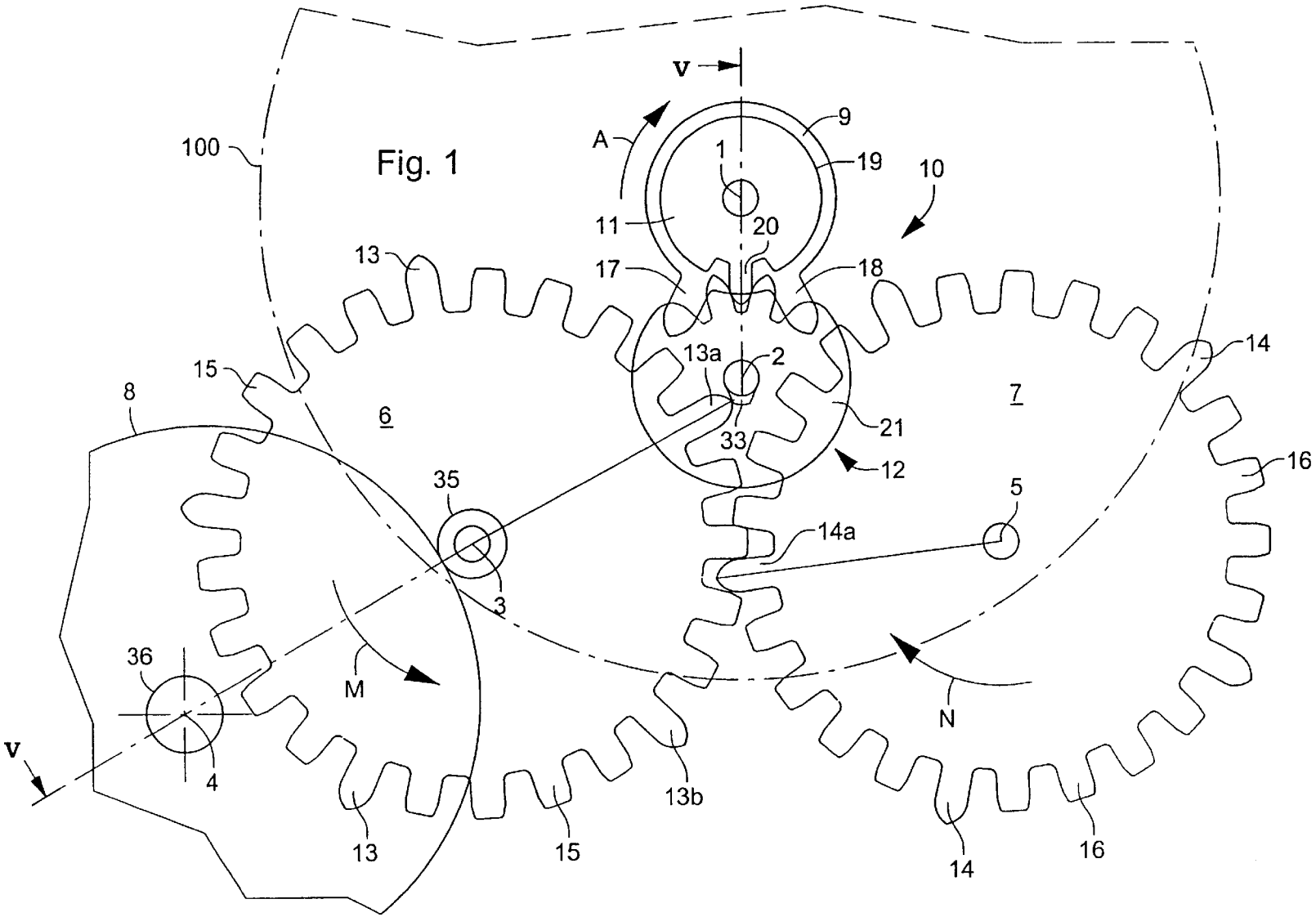
FIG. 1 is a plane view of the escapement according to the invention, this escapement being shown in a first operating phase.

FIGS. 1 to 4 are plane views of four successive phases of the escapement of the invention. Escapement 10 is arranged, in a known manner, between a gear train and a sprung balance of a timekeeper. By definition, the gear train or system is the assembly of wheels and pinions which, from a barrel, transmits the driving force to an escapement wheel. In FIG. 1, the gear train is shown by its last wheel 8, associated with pinion 36. Wheel 8 drives a first escapement or impulse wheel 6 by pinion 35 which is secured thereto. First wheel 6 meshes with a second escapement or impulse wheel 7. It will be noted here that wheel 8 could drive second wheel 7 in place of first wheel 6. FIGS. 1 to 4 also show first and second rollers 9 and 11 secured to a common arbor 1 to which is fixed a sprung balance 100. As the Figures show, first and second wheels 6 and 7 as well as first roller 9 are provided with means allowing first roller 9 to receive direct impulses supplied alternately by first and second wheels 6 and 7 for the purpose of maintaining the oscillations of the balance. Likewise, the Figures show that second roller 11 is provided with means for driving a locking and rocking member 12 arranged to lock said first and second wheels 6 and 7 alternately.

Figure 5:
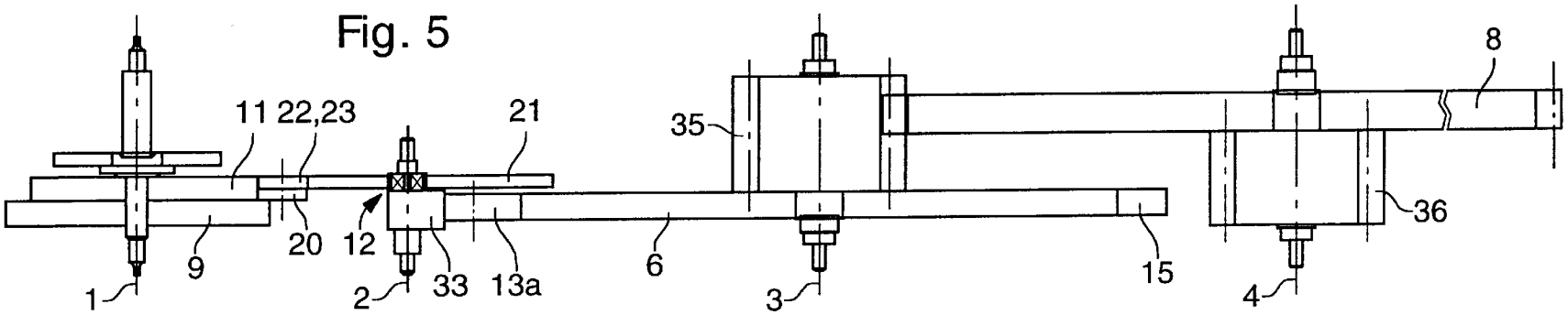
FIG. 5 is a cross-section along the line V—V of FIG. 1.
Figure 6:
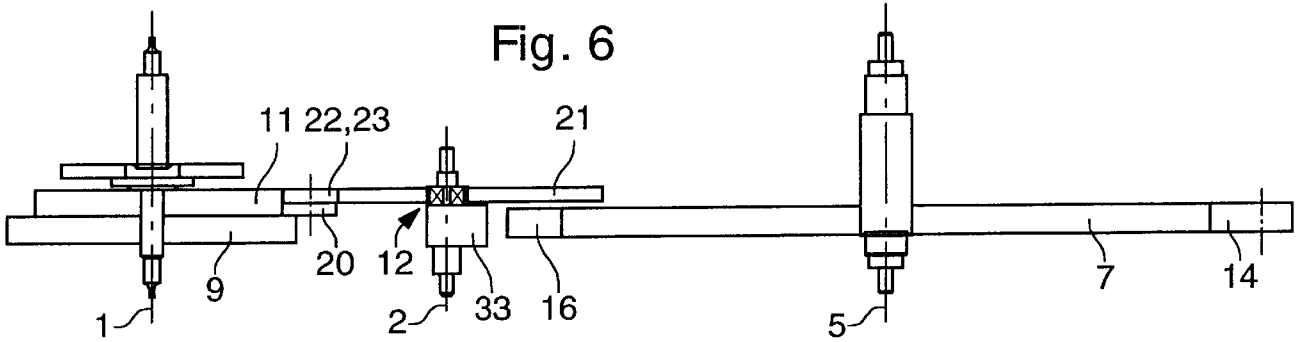
FIG. 6 is a cross-section along the line VI—VI of FIG. 3.
Figure 7:
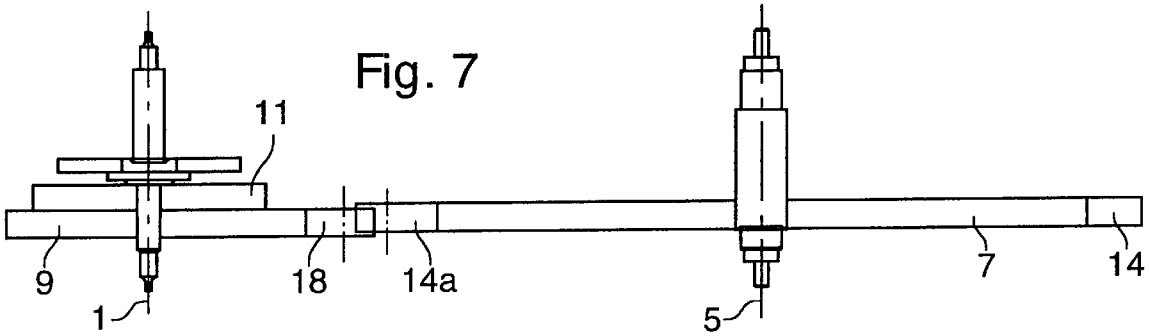
FIG. 7 is a cross-section along the line VII—VII of FIG. 3.

The above paragraph is a definition of the new escapement in its broadest sense. A particular embodiment answering this definition will now be examined, this embodiment being illustrated by the same FIGS. 1 to 4, as well as by FIGS. 5 to 7 which are cross-sections through the plane views of FIGS. 1 and 3.

Figure 2:
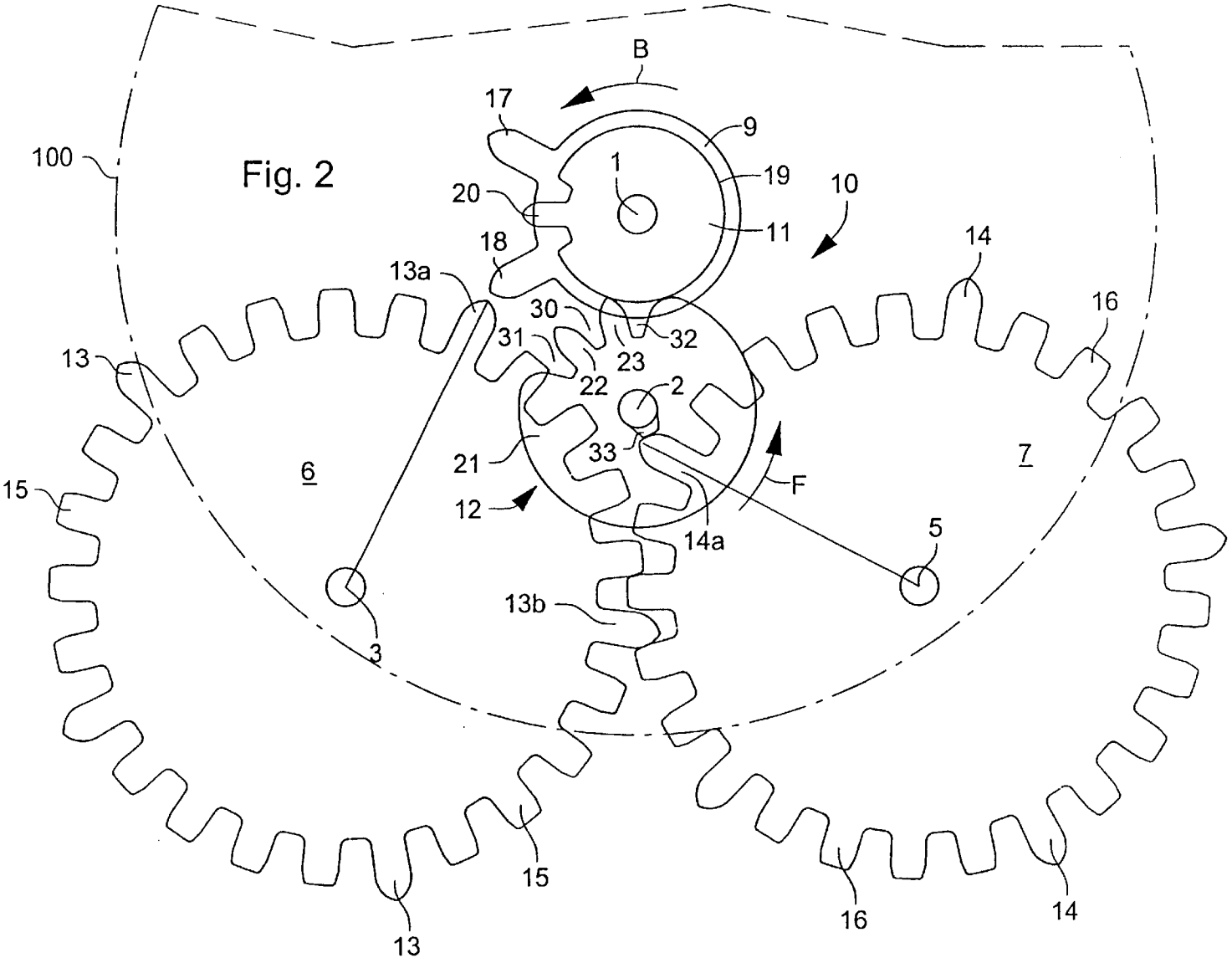
FIG. 2 is the same view as in FIG. 1, the escapement being shown in a second operating phase.
Figure 3:
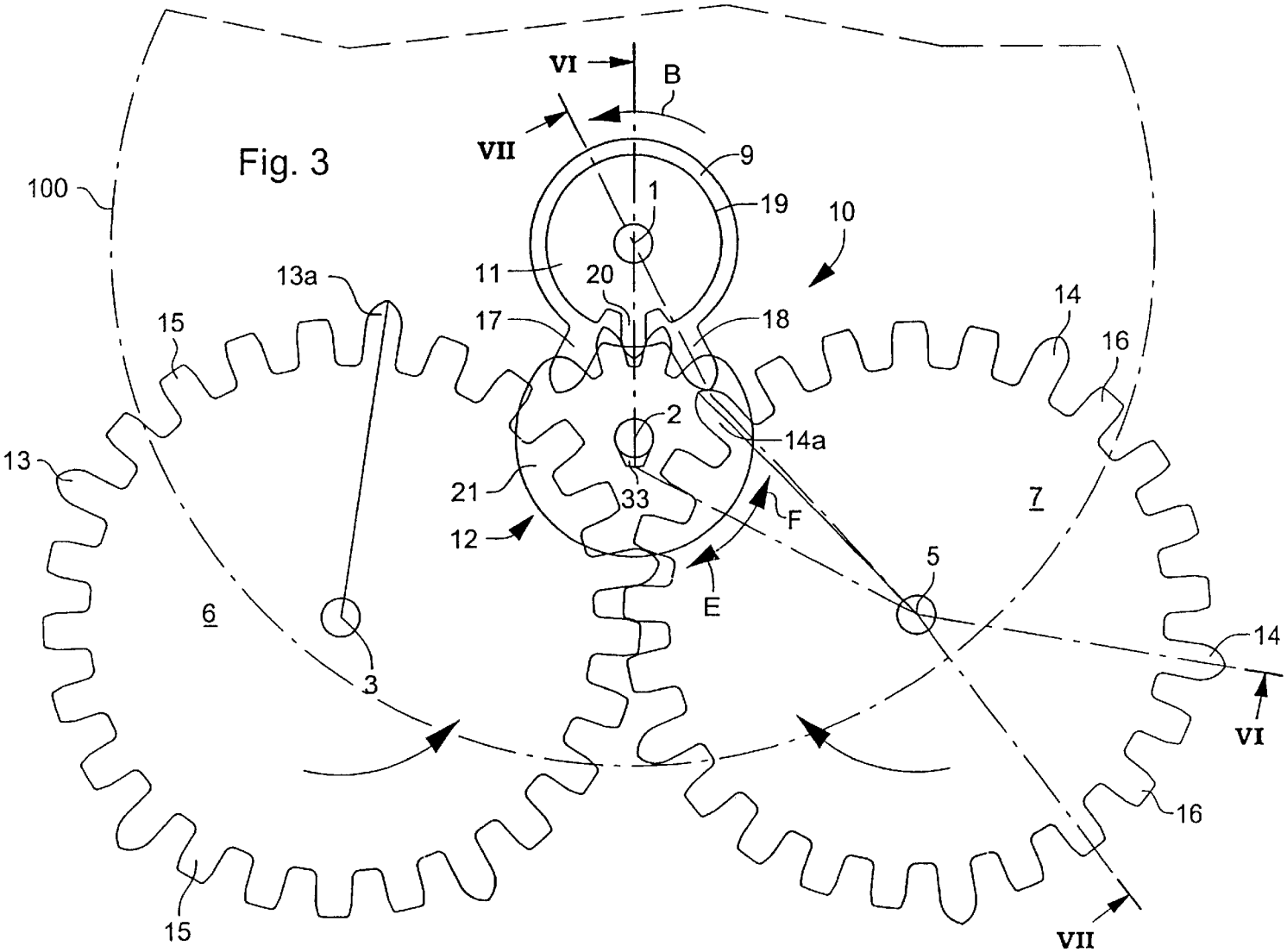
FIG. 3 is the same view as in FIG. 1, the escapement being shown in a third operating phase.
Figure 4:
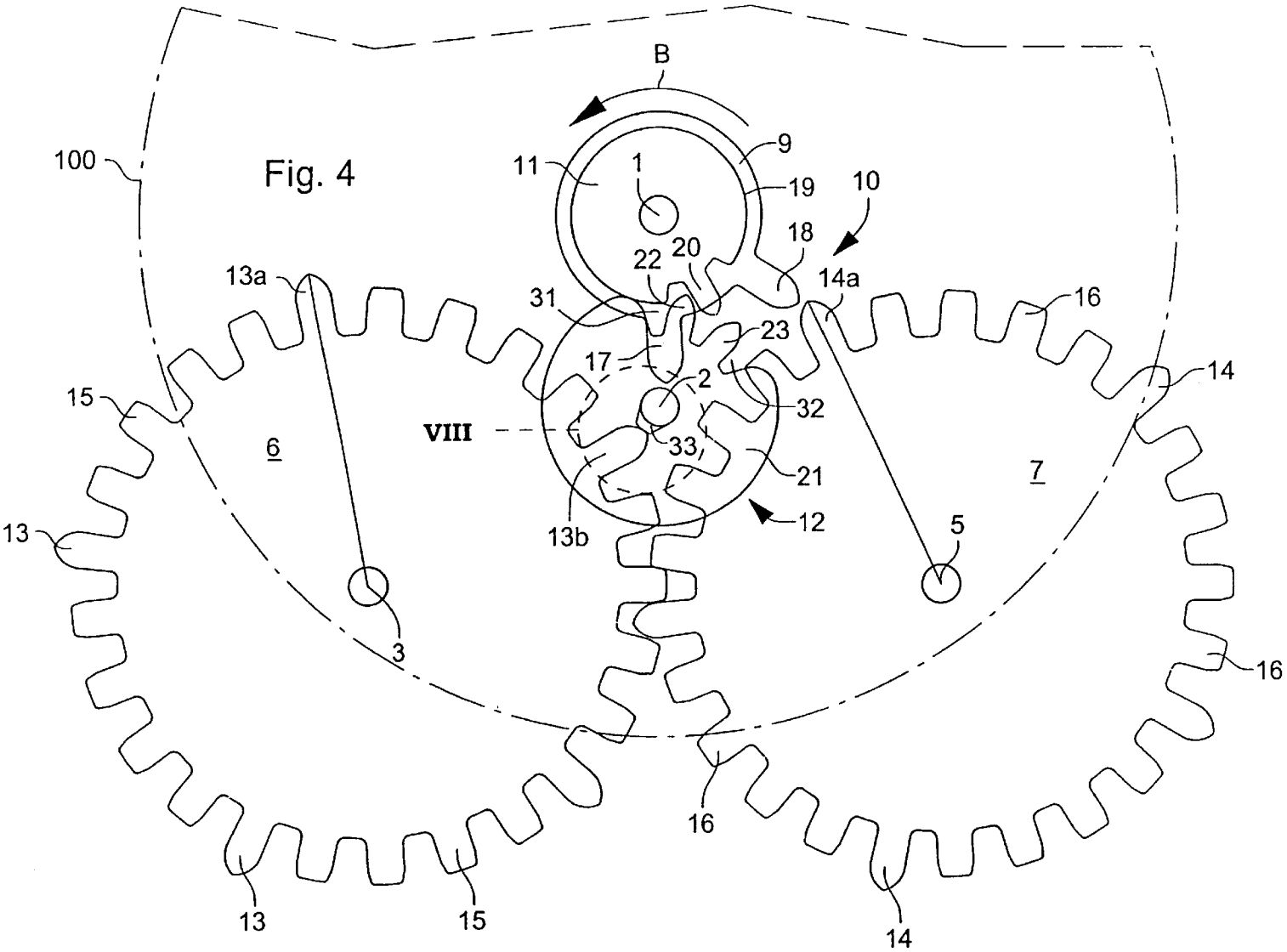
FIG. 4 is the same view as in FIG. 1, the escapement being shown in a fourth operating phase.

FIGS. 1 to 4 show that first and second impulse wheels 6 and 7 have an identical toothing and the same diameter. This toothing is made up of a restricted number (5 here) of long teeth references 13 for wheel 6 and 14 for wheel 7. Long teeth 13 of wheel 6 are each separated by a plurality of short teeth 15 (4 here). Likewise long teeth 14 of wheel 7 are each separated by a plurality of short teeth 16 (here 4). First roller 9, fixed to arbor 1, to which is fixed the inner end of the sprung balance 100, includes first and second lugs 17 and 18. First lug 17 is arranged to receive an impulse supplied by a long tooth 13*a* of first wheel 6 to drive the balance supplied by arbor 1, in a first direction A as can be seen in FIG. 1. Likewise, second lug 18 is arranged to receive an impulse supplied by a long tooth 14*a* of second wheel 7 to drive the balance in a second direction B, opposite to first direction A, as is apparent in FIG. 3. FIGS. 1 to 4 also show that second roller 11, secured to arbor 1 includes a disc 19 from which emerges a finger-piece 20. This finger-piece 20 is capable of driving locking and rocking member 12 (see FIG. 3) alternately in a first direction E to lock first wheel 6 by one of its long teeth 13, then in a second direction F, opposite to direction E, to lock second wheel 7 by one of its long teeth 14. The first locking situation is shown in FIG. 4 and the second in FIG. 2.

An embodiment of locking and rocking member 12 remains to be described. FIGS. 1 to 4 show that this rocking member 12 is formed of a disc 21 pivoting on an arbor 2. Into this disc 21 are cut two teeth 22 and 23 between which finger-piece 20 of second roller 11 can penetrate to cause the rocking member to pivot. Disc 21 of rocking member 12 carries a cam or catch 33 against which long teeth 13 and 14 of first and second wheels 6 and 7 abut alternately, as is apparent in FIGS. 4 and 2 respectively.

As an embodiment of the new escapement as well as the functions fulfilled by the various parts forming said escapement have been described hereinbefore, the actual operating mode thereof will now be reviewed, by describing a complete operating cycle. FIGS. 1 to 4, which show four important phases of this cycle will be examined in turn.

First phase (FIG. 1)

It is assumed that the barrel spring is let down completely. The mechanism is in the rest position. Long tooth 13*a* of wheel 6 is unlocked from catch 33. Finger-piece 20 of second roller 11 is engaged between teeth 22 and 23 of disc 21 forming rocking member 12. Lug 17 of first roller 9 is in position to receive tooth 13*a* of first wheel 6. From this situation, if the barrel spring, is wound, first wheel 6 begins to rotate in the direction of arrow M which drives second wheel 7 in the direction of arrow N. Long tooth 13*a* begins to rotate in the direction of arrow M, meets lug 17 and rotates first and second rollers 9 and 11 in the direction of arrow A which gives a direct impulse to the balance and initiates the first vibration of said balance.

Second phase (FIG. 2)

The rotation of second roller 11 has driven rocking member 12 in an anticlockwise direction F so that its catch 33 is on the path of long tooth 14*a* of second wheel 7. Thus wheel 7 is locked, which also causes wheel 6 to lock. When it reaches the end of the first vibration, the rotational direction of the balance is reversed. The second vibration then begins in the direction of arrow B which drives first and second rollers 9 and 11 in the same direction.

Third phase (FIG. 3)

By rotating in the direction of arrow B, finger-piece 20 of second roller 11 penetrates between teeth 22 and 23 of rocking member 12 which has the effect of causing the latter, as well as catch 33 which is linked thereto, to rotate in the direction of arrow E. Long tooth 14*a*, which then abuts against this catch, is now free to continue its course and to meet lug 18 of first roller 9 to give another impulse to the balance.

Fourth phase (FIG. 4)

Once the impulse is received, second roller 11 continues its course in the direction of arrow B and drives rocking member 12 in the clockwise direction so that its catch 33 is then on the path of long tooth 13*b* of first wheel 6. Thus, in turn, wheel 6 locks, which also causes wheel 7 to lock. Unlocking will occur during the next vibration of the balance and the cycle can start again.

FIGS. 1 to 4 show that each of first and second impulse wheels 6 and 7 carry twenty-five teeth, of which five long teeth 13 and 14, four short teeth 15 and 16 are interposed between two long teeth. In the event that a sprung balance making either vibrations per second (namely 28,800 vibrations per hour) is used, which is usual for a wristwatch, the balance will make 4 oscillations per second. It is clear from the foregoing that one oscillation causes wheel 6 to advance by 360 degrees divided by five long teeth, i.e. a step of 72 degrees. As a result, wheel 6 progresses by 4 steps per second i.e. 4×72=288 degrees and finally completes a revolution of 360 degrees in 1.25 seconds.

Figure 8:
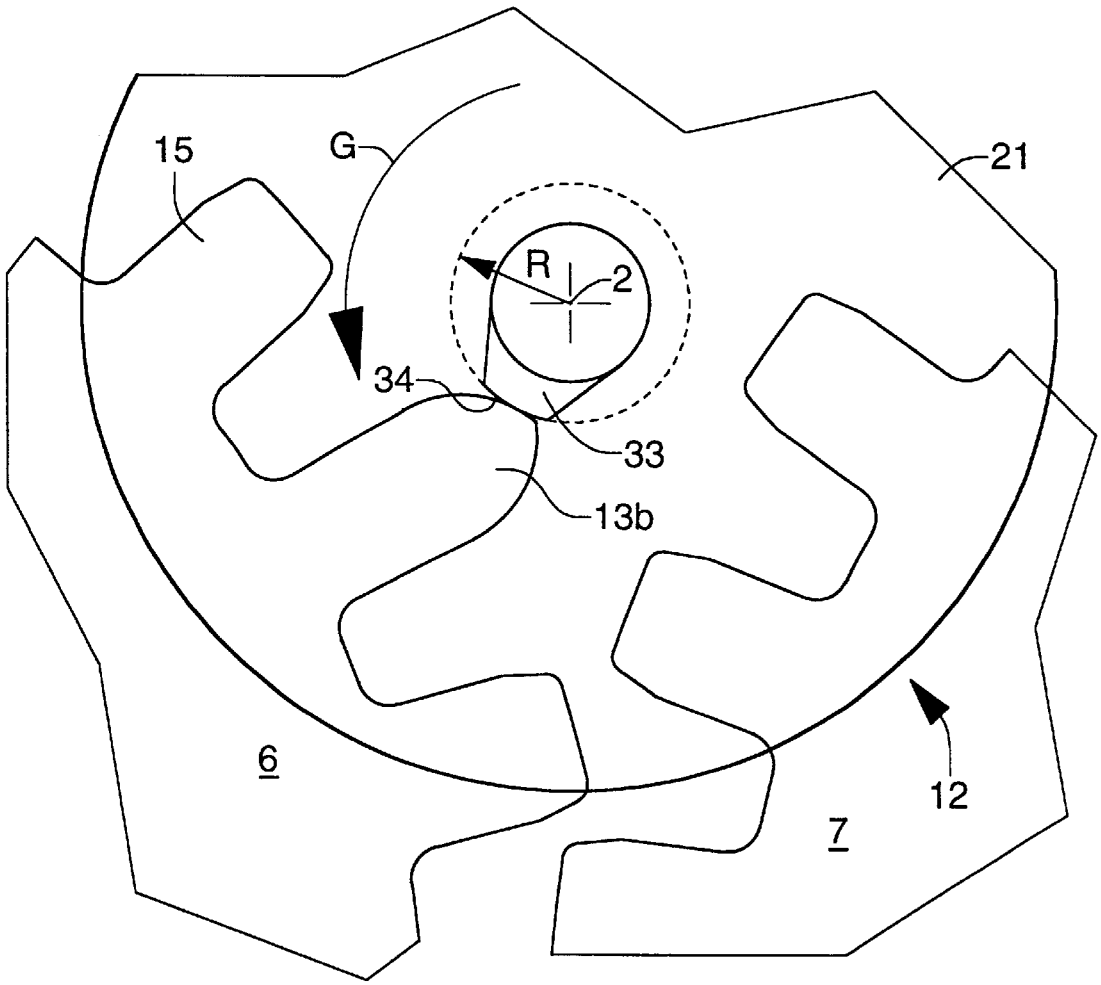
FIG. 8 is an enlarged plane view of the zone VIII of FIG. 4.

FIG. 8 is an enlargement of zone VIII shown in FIG. 4 and emphasises the way in which long tooth 13*b* rests on catch 33 of rocking member 12. This FIG. 8 shows clearly that face 34 of catch 33, against which long teeth 13 and 14 abut alternately, is shaped in an arc of a circle, the radius R of this arc passing through the pivoting centre 2 of rocking member 12.

Thus, it will be understood that when catch 33 retracts during rotation of rocking member 12 in the direction of arrow G, wheel 6 does not recoil at all. In conclusion, the drawback of recoil due to the lever escapement draw does not exist in the new escapement proposed here.

To return to rocking member 12 shown in FIG. 2, it will be observed that the two teeth 22 and 23 cut into disc 21 define three spaces. A first gap 30 is situated between the two teeth 22 and 23. Finger-piece 20 of second roller 11 can penetrate this gap 30 to cause the rocking member to pivot. Second and third gaps 31 and 32 are situated on either side of the pair of teeth 22 and 23, into which disc 19 of second roller 11 can penetrate alternately and partially, for the purpose of immobilising the rocking member after it has pivoted. Thus, as is seen particularly well in FIG. 2, disc 19 of second roller 11 partially penetrates gap 32 formed after tooth 23 of the rocking member. This artifice is important since in the situation in which tooth 14*a* is locked by rocking member catch 33, the rocking member must not be able to rotate inadvertently, for example via the effect of a shock applied to the timepiece.

To summarise the foregoing, the new escapement proposed has all the advantages of known escapements while avoiding the drawbacks thereof. This is largely due to the exclusive use of rotating wheels and pinions of conventional geometry, while avoiding the use of levers, springs or inclined planes, elements which disturb proper dynamic operation. There results a new escapement of great theoretical simplicity in which only circular parts, moments of force, peripheral speeds and inertia of wheels and pinions with axial symmetry play a part. Thus, a construction of this type allows the loss of power on unlocking (recoil) to be removed, a direct impulse to be obtained in both directions, self-starting to be maintained and operating safety to be guaranteed by design (overbanking avoided).

What is claimed is:

1. An escapement arranged between a gear train and a sprung balance of a timekeeper, wherein it includes first and second impulse wheels meshing with each other, one of these wheels being driven by the gear train, and first and second rollers secured to a common arbor to which the sprung balance is fixed, the first and second wheels and the first roller being provided with means allowing said first roller to receive direct impulses supplied alternately by the first and second wheels for the purpose of maintaining the oscillations of the balance, said second roller being provided with means for driving a locking and rocking member arranged to lock said first and second wheels alternately.

2. An escapement according to claim 1, wherein the first and second impulse wheels have an identical toothing made of a restricted number of long teeth each separated by a plurality of short teeth, wherein the first roller includes first and second lugs arranged, the first for receiving an impulse supplied by a long tooth of the first wheel to drive the balance in a first direction, and the second for receiving an impulse supplied by a long tooth of the second wheel to drive the balance in a second direction opposite to the first, and wherein the second roller includes a disc from which emerges a finger-piece capable of driving the locking and rocking member alternately in a first direction to lock the first wheel by one of its long teeth, then in a second direction, opposite to the first, to lock the second wheel by one of its long teeth.

3. An escapement according to claim 2, wherein the locking and rocking member is formed of a disc which pivots about its arbor, two teeth being cut into said disc between which the finger-piece of the second roller is capable of penetrating in order to cause the rocking member to pivot, this disc carrying a catch against which the long teeth of the first and second wheels alternately abut.

4. An escapement according to claim 2, wherein each of the first and second impulse wheels carries twenty-five teeth, of which five are long teeth, four short teeth being inserted between two long teeth.

5. An escapement according to claim 3, wherein the face of the catch against which the long teeth alternately abut, is shaped in an arc of a circle, the radius of this arc passing through the pivoting centre of the rocking member.

6. An escapement according to claim 3, wherein the two teeth cut into the disc forming the rocking member define three gaps, a first gap situated between the two teeth and into which the finger-piece of the second roller can penetrate to cause the rocking member to pivot, and second and third gaps situated on either side of the pair of teeth, into which the disc of the second roller can penetrate alternately and partially, after the rocking member has pivoted, in order to immobilise said rocking member.

* * * * *